United States Patent [19]

Hahn et al.

[11] Patent Number: 4,602,834

[45] Date of Patent: Jul. 29, 1986

[54] ELECTRICAL JUMPER

[75] Inventors: Marlyn E. Hahn, York; Tamera L. Fair, Highspire, both of Pa.

[73] Assignee: E. I. DuPont de Nemours and Company, Wilmington, Del.

[21] Appl. No.: 723,524

[22] Filed: Apr. 15, 1985

[51] Int. Cl.[4] ..... H01R 31/08

[52] U.S. Cl. ..... 339/19

[58] Field of Search ..... 339/19, 59 R, 59 M, 339/198 S, 198 P, 222, 242

[56] References Cited

U.S. PATENT DOCUMENTS

| | | | |
|---|---|---|---|
| 3,145,067 | 8/1964 | Mishelevich et al. | 339/75 |
| 3,256,510 | 6/1966 | Van Horssen | 339/198 |
| 3,517,370 | 6/1970 | Poingt | 339/59 |
| 3,697,925 | 10/1972 | Henschen | 339/17 F |
| 4,013,331 | 3/1977 | Kobler | 339/59 R |
| 4,046,450 | 9/1977 | Yurtin | 339/217 S |
| 4,186,987 | 2/1980 | Pearce, Jr. et al. | 339/116 C |
| 4,206,959 | 6/1980 | DeVries | 339/59 R |
| 4,283,100 | 8/1981 | Griffin et al. | 339/19 |
| 4,295,698 | 10/1981 | Chow | 339/59 R |
| 4,383,724 | 5/1983 | Verhoeven | 339/19 |
| 4,482,198 | 11/1984 | Crowley | 339/19 |

*Primary Examiner*—Neil Abrams

[57] ABSTRACT

An electrical jumper is disclosed as having a terminal member which is retained in a housing by a latch. The latch cooperates with rails in the housing on which the terminal member is supported, leaving clearance for the terminal member to ride under and snap onto the latch. The jumper can be provided on single or multiple units, including a bus bar configuration.

12 Claims, 20 Drawing Figures

FIG. 3
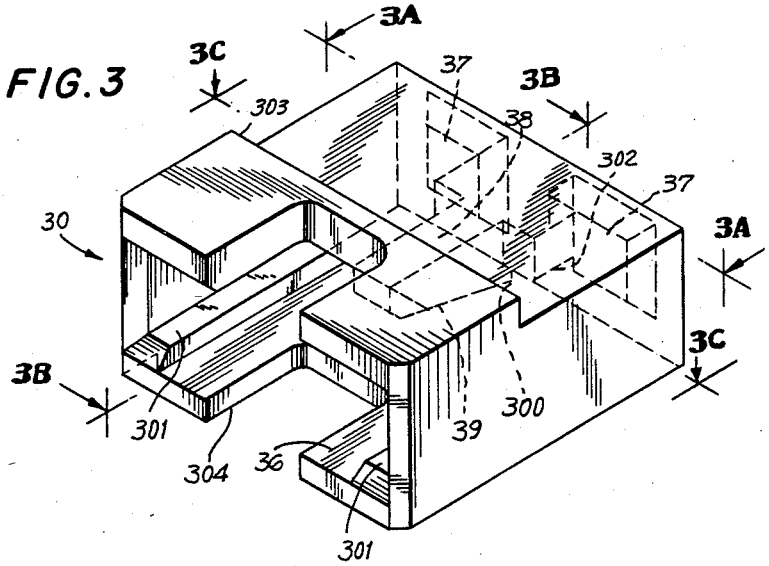
FIG. 3A
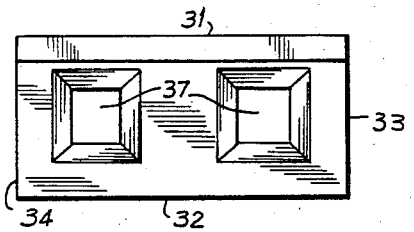
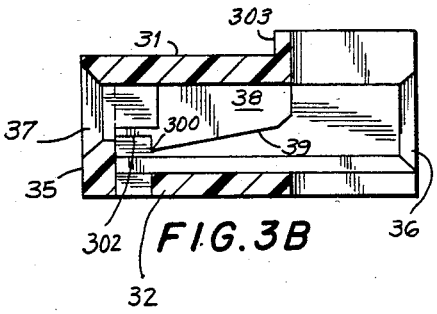
FIG. 3B
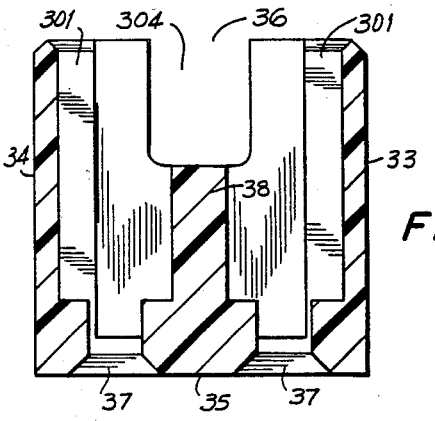
FIG. 3C

FIG. 4
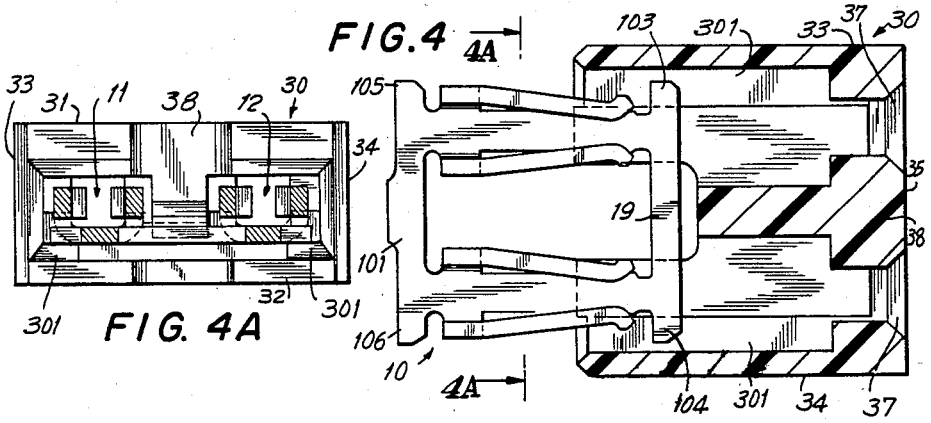
FIG. 4A
FIG. 5
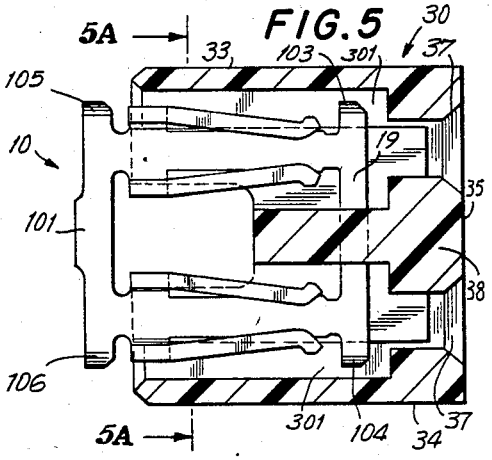
FIG. 5A
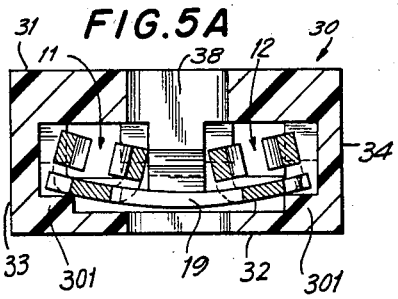
FIG. 6
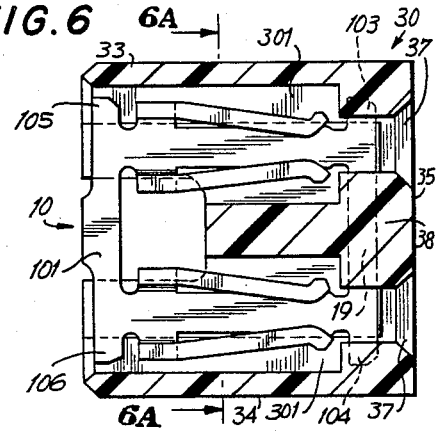
FIG. 6A
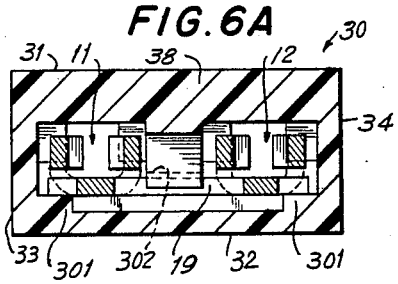

8
8
37
71
73
72
70
80
81
301
38

ELECTRICAL JUMPER

BACKGROUND OF THE INVENTION

This invention relates to electrical connectors, and particularly to an electrical jumper for electrically connecting two or more adjacent pins which extend from electronic devices.

Printed circuit boards are typically provided with a row or array of pins (a "pin field") to facilitate making connections between the electronic components on the board and external devices including other printed circuit boards. Electronic equipment, including digital computers, may also be provided with such pin fields for connecting the equipment to peripheral devices or data communication lines.

If a printed circuit board is capable of several uses, the devices which can be connected to its pin field may vary. This is almost certainly the case with a pin field of a general purpose device such as a digital computer. For some applications, it may be necessary to "jump", or electrically interconnect, two or more pins in the pin field. The jumped pins may or may not have further connections made to them.

It is therefore known to provide jumpers which can interconnect two or more pins in a pin field. The jumpers are generally rectangular and of such dimensions that there is sufficient space to connect additional jumpers on adjacent pins. The jumpers have an entry end with apertures for the entry of the pins, and are generally shorter than the pins so that the pins protrude from the opposite, exit end of the jumper to allow additional connections to be made to them. Because of their small dimensions, these jumpers are sometimes called "low profile" jumpers.

Such jumpers have a housing made of a non-conductive, dielectric material, having electrically interconnected terminals for receiving the pins to be jumped. It is known to provide electrically interconnected terminals by forming the entire terminal member from one piece of conductive material, by stamping or otherwise. A conductive material commonly used in a metal, such as hard phosphor bronze, plated with nickel, then overplated with gold or a tin/lead alloy.

In one particular known type of jumper for interconnecting two pins, the terminal member has four arms, two for engaging each pin. Each pair of arms engages its respective pin from two sides. Each arm is provided with a dimple for better contact with its respective pin. The arms extend from a central spine, which is received in a slot in the housing, across to the sides of the housing. The free ends of the arms are supported in slots in the sides of the housing.

This known type of jumper functions well, but is not easily assembled automatically at high speeds. The free ends of the arms of the terminal member are sometimes bent out of place before the terminal member is inserted into the housing, so that they do not align properly with the slots intended to receive them. Alternatively, the arms may bend in the slots if accumulated tolerances are such that a maximum width arm is mated to a minimum width slot. As a result, the arms bend instead of seating properly in the slots. Such a jumper must then be discarded. Therefore, this type of jumper is assembled by hand.

In addition, when forming the dimples in the arms of the known jumper, if the metal which is used for the terminal member has been plated before the dimples are formed ("pre-plated"), there is a tendency for the base metal to break through the plating when the dimple is formed. Therefore, the terminal members of the known jumper are plated after they are formed. Such post-plating is a more difficult and expensive step than pre-plating.

Jumpers of the types generally described above can be provided in multiple units which allow discrete pairs of pins to be electrically connected by a number of electrically isolated terminal members in a common housing. In addition, jumpers can be provided which interconnect a multiplicity of pins in a bus bar configuration.

SUMMARY OF THE INVENTION

It is therefore an object of this invention to provide a low profile jumer that can be assembled automatically at high speed.

It is another object of this invention to provide a low profile jumper which has a terminal member that can be formed from pre-plated metal.

It is a further object of this invention to provide a low profile jumper having a terminal member which is relatively simple to manufacture.

In accordance with this invention, a jumper for electrically connecting terminal pins is provided including a housing of dielectric material having a solid rectangular shape, an entry end having at least one pair of apertures for receiving said pins, an open exit end opposite said entry end, first and second long side walls parallel to each other and perpendicular to said entry and exit ends, first and second short side walls parallel to each other and perpendicular to said entry and exit ends and to said long side walls, a latch associated with each said pair of apertures comprising a ramp having a latch width and extending from said first long side wall toward said entry end and toward said second long side wall between the two apertures of said pair of apertures, and further having a lip adjacent said entry end and said second long side wall, said lip being a first preselected distance from said second long side wall and a second preselected distance from said entry end and having a lip height, the sum of said lip height and said first preselected distance defining a third preselected distance, and a respective rail member extending along said second long side wall from said entry and to said exit end on either side of each said pair of apertures, each of said rail members projecting a fourth preselected distance from said second long side wall. In the housing is a terminal member associated with each said pair of apertures comprising a pair of twinbeam terminals of electrically conductive material for alignment with said apertures, each of said terminals having an entry end and an exit end, the entry and exit ends of each said terminals connected to the entry and exit ends, respectively, of the other of said terminals by a respective electrically conductive cross-piece, each of said cross-pieces having a thickness greater than the difference between said first preselected distance and said fourth preselected distance, no greater than the difference between said third preselected distance and said fourth preselected distance, and no greater than said first preselected distance, and a width approximately equal to and no greater than said second preselected distance. The terminal member has a rectangular opening formed by said pair of terminals and said cross-pieces. The opening has a width no less than said latch width. The terminal number further has four tabs extending laterally outwardly from the corners thereof, the tabs being formed by extensions of the cross-pieces. The terminal member is supported in the housing on the rail members, spaced from the second long side wall, by the tabs. The lip of the latch engages the cross-piece that connects the entry ends of the terminals, with the latch extending into the rectangular opening, thereby retaining the terminal member in the housing.

BRIEF DESCRIPTION OF THE DRAWINGS

The above and other objects and advantages of the invention will be apparent upon consideration of the following detailed description thereof, taken in conjunction with the accompanying drawings, in which like reference characters refer to like parts throughout, and in which:

FIG. 3 is a perspective view of a preferred embodiment of the housing according to this invention;

FIG. 3A is an entry end elevational view of the housing of FIG. 3 taken from line 3A—3A of FIG.3;

FIG. 3B is a cross-sectional view of the housing of FIG. 3, taken from line 3B—3B of FIG. 3;

FIG. 3C is a cross-sectional view of the housing of FIG.3, taken from line 3C—3C of FIG. 3;

FIGS. 4, 5 and 6 are cross-sectional views of successive steps in the insertion of the terminal member of FIG. 1 into the housing of FIG. 3, taken from line 3C—3C of FIG. 3;

FIGS. 4A, 5A and 6A show cross-sectional views of the FIGS. 4, 5 and 6, taken from lines 4A—4A, 5A—5A and 6A—6A, respectively;

DETAILED DESCRIPTION OF THE INVENTION

Figure 1:
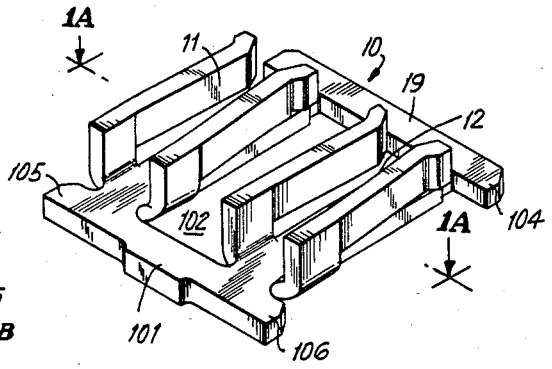
FIG. 1 is a perspective view of the terminal member according to this invention.
Figure 1A:
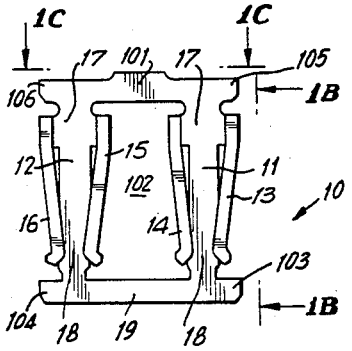
FIG. 1A is a plan view of the terminal member of FIG. 1, taken from line 1A—1A of FIG. 1.
Figure 1C:
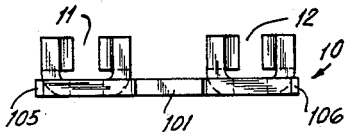
FIG. 1C is an end view of the terminal member of FIG. 1, taken from line 1C—1C of FIG. 1A.
Figure 1B:
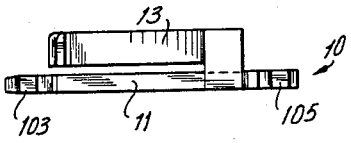
FIG. 1B is a side elevational view of the terminal member of FIG. 1, taken from line 1B—1B of FIG. 1A.

The jumper of this invention can be made as a single jumper, as multiple, physically connected but electrically separate jumpers, or as multiple, physically and electrically connected jumpers.

The preferred embodiment of a single jumper according to this invention is shown in FIGS. 1–6A. The jumper includes the terminal member shown in FIGS.-1–2 and the housing shown in FIGS. 3–6A.

The terminal member 10 includes two terminals 11, 12 of the twin-beam type. Each terminal 11, 12 includes two strips, or "beams", 13, 14 and 15, 16, respectively, connected at their proximal ends 17 to the terminal and held in fixed, spaced-apart relationship. The beams 13, 14 and 15, 16 converge as they extend along their respective terminals 11, 12 reaching a point of closest proximity adjacent their distal ends 18 and then flaring slightly at ends 18.

Ends 18 are the entry ends of terminals 11, 12, through which contact pins (not shown) are inserted into the terminals. Ends 17 are the exit ends of terminals 11, 12 through which the contact pins protrude if they are longer than terminals 11, 12. The convergence of the beams 13, 14 and 15, 16 and the resiliency of the metal from which they are made give rise to positive frictional and electrical contact between each terminal 11, 12 and the pin inserted therein.

Terminals 11, 12 of terminal member 10 are interconnected by entry end cross-piece 19 and exit end cross-piece 101. Terminals 11, 12 and cross-pieces 19, 101 together form rectangular opening 102 in terminal member 10. Entry end cross-piece 19 is extended beyond terminals 11, 12 to form tabs 103, 104. Exit end cross-piece 101 is similarly extended to form tabs 105, 106.

Figure 2:
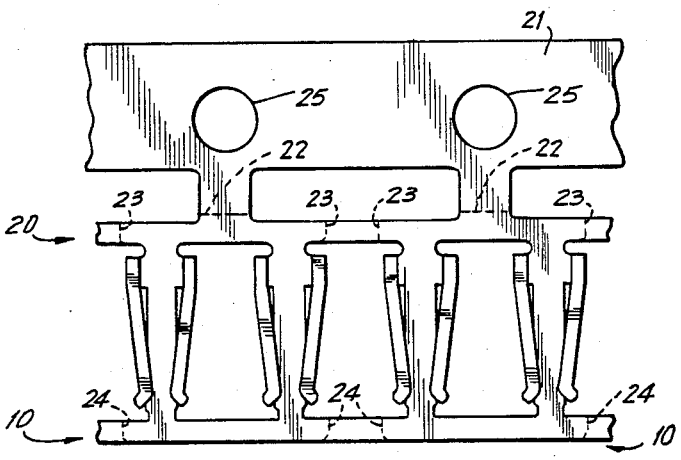
FIG. 2 is a plan view of a number of terminal members attached to a carrier strip.

FIG. 2 shows a strip 20 of terminal members 10. Terminal members 10 are manufactured as a unit, attached to carrier 21, by stamping from a single piece of electrically conductive metal. Strip 20 is fed into the machine which assembles terminal members 10 into the housings to be described below. The individual terminal members 10 are broken off strip 20 as they are assembled by severing score lines 22, 23, 24. Holes 25 in carrier 21 are provided for proper indexing of strip 20 during assembly.

Terminal members 10 are preferably plated for improved conductivity. A preferred composition for terminal members 10 is a substrate of hard phosphor bronze with a plating of nickel and an overplating of substantially pure gold or an overplating of a 93/7 tin/-lead alloy.

Single jumper housing 30 is made of a dielectric material, preferably a plastic. A particularly preferred plastic is glass-filled polyester. Housing 30 has first and second long side walls 31, 32, first and second short side walls 33, 34, an entry end 35, and an open exit end 36. Entry end 35 has two apertures 37 for receiving contact pins. Apertures 37 are aligned with terminals 11, 12. A commonly used pin spacing in the type of electronic devices for use with which this invention is intended is 0.100 inch (2.54 mm), and therefore the preferred separation distance for apertures 37 (and for terminals 11, 12) is 0.100 inch (2.54 mm). However, other spacings can be provided and, in fact, the jumper of the invention can be used for applications that do not involve printed circuit boards.

Projecting into housing 30 from first long side wall 31, and centered between the two apertures 37, is a latch 38 for retaining terminal member 10 in housing 30. Latch 38 includes a ramp 39 extending from first long side wall 31 toward second long side wall 32 and toward entry end 35. At the end of ramp 39 is a lip 300. Latch 38 cooperates with rail members 301, which extend along second long side wall 32 from entry end 35 to exit end 36 of housing 30 on either side of the pair of apertures 37, as explained below.

FIGS. 4–6A show the sequence of events in inserting terminal member 10 into housing 30. In FIGS. 4 and 4A, terminal member 10 has been inserted into exit end 36 of housing 30, with tabs 103, 104 riding on rails 301.

Entry end cross-piece 19 has not yet reached ramp 39. In FIGS. 5 and 5A, cross-piece 19 has reached ramp 39 and has begun to bow (exaggerated in FIG. 5A) into the space between ramp 39 and second long side wall 32. Cross-piece 19 is free to bow because it is held away from second long side wall 32 by tabs 103, 104 riding on rails 301. In FIGS. 6 and 6A, cross-piece 19 has cleared lip 300 of ramp 39 and has snapped back to its normal configuration. Tabs 105 and 106 are now also riding on rails 301. As best seen in FIG. 6A, lip 300 engages cross-piece 19 to prevent the withdrawl of terminal member 10 from housing 30.

Instead of providing tabs 103, 104, 105, 106 to ride on rails 301, the body of terminal member 10 could be made to extend laterally far enough to ride rails 301. However, that would increase both the frictional contact between terminal member 10 and rails 301, and the amount of material needed to fabricate terminal member 10.

The dimensions of ramp 39, lip 300 and rails 301 must be within certain limits in order for latch 38 to function as intended. First, ramp 39 can be no wider than opening 102 in terminal member 10 so that it can fit between terminals 11, 12. Second, lip 300 can be no closer to entry end 35 of housing 30 than the width of cross-piece 19 so that cross-piece 19 can fit into the position shown in FIG. 6. Third, the tip of lip 300 can be no closer to second long side wall 32 than the thickness of cross-piece 19, so that cross-piece 19 can fit between lip 300 and second long side wall 32 as shown in FIG. 5A. Fourth, the difference between the distance from lip 300 to second long side wall 32 and the distance that rail members 301 project from second long side wall 32 must be less than the thickness of cross-piece 19, otherwise cross-piece 19 will not be retained by lip 300. Fifth, the distance between the surfaces of rail members 301 and the plane of surface 302 (the distance between the tip of lip 300 and surface 302 definging the "lip height" of lip 300) must be at least the thickness of cross-piece 19, so that cross-piece 19 can fit into the position shown in FIG. 6A. However, the distance can be greater, as it is in FIG. 6A, allowing terminal number 10 to have a small degree of "float" within the housing.

When terminal member 10 and housing 30 have been assembled to form a jumper, the jumper can then be pressed onto the pins which are desired to be connected. For removal of the jumper from the pins, housing 30 is provided with raised portion 303 on the exterior of first long side wall 31 which provides a gripping surface for a jumper removal tool. In addition, cutouts 304 are provided in long side walls 31, 32 to expose exit end cross-piece 101 for gripping by a jumper removal tool.

Figures 7, 8A, 8B:
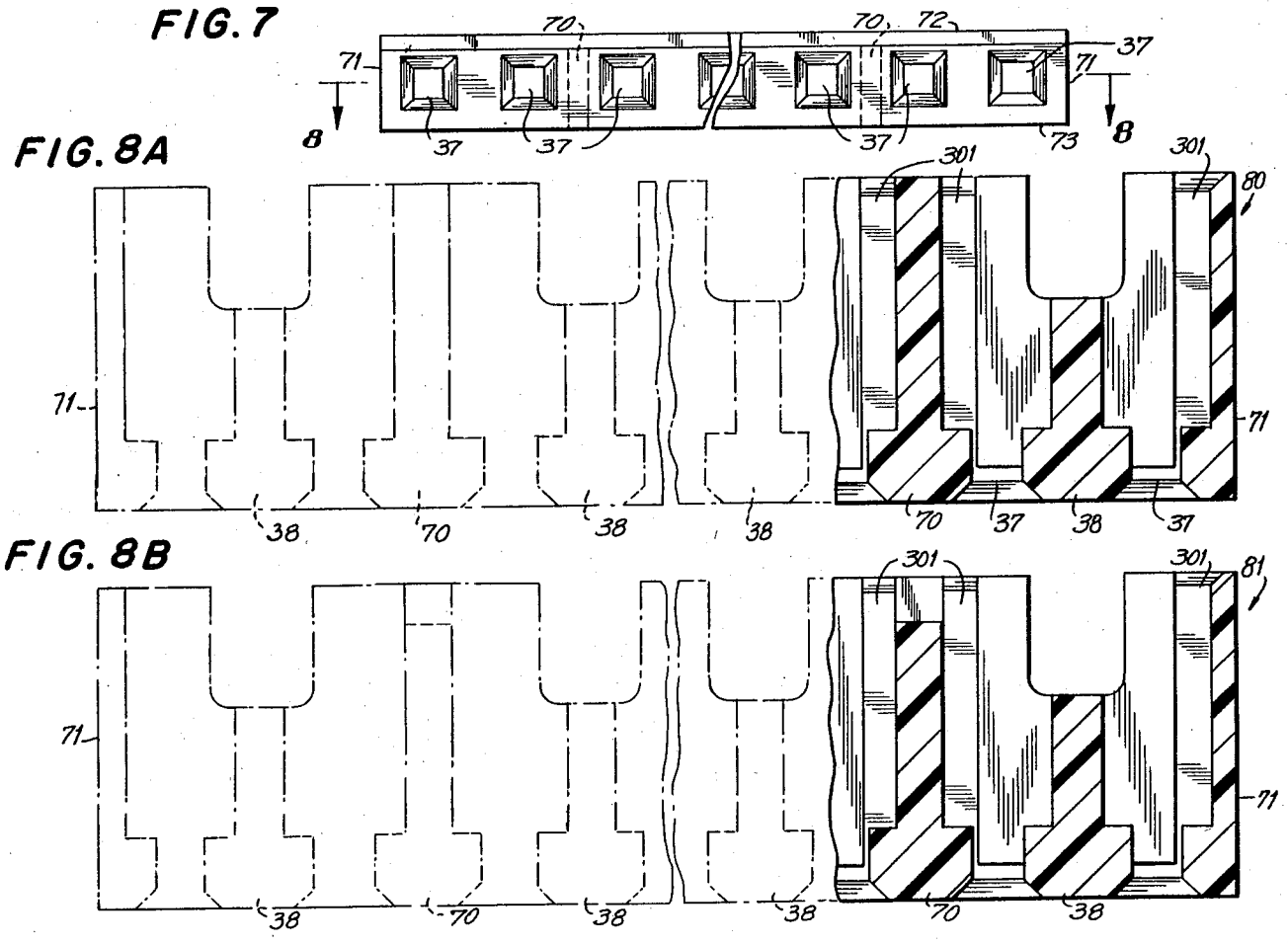
FIG. 7 is an entry end elevational view of another preferred embodiment of the housing of this invention.
FIG. 8A is a cross-sectional view of one embodiment of the interior arrangement of the housing of FIG. 7, taken along line 8—8 of FIG. 7.
FIG. 8B is a cross-sectional view of another embodiment of the interior arrangement of the housing of FIG. 7, taken along line 8—8 of FIG. 7.

In addition to the single jumper described above, this invention also includes several types of multiple jumper. FIG. 7 shows the exterior of the entry end of two different types 80, 81 of multiple jumpers, the cross sections of which are shown in FIGS. 8A and 8B, respectively. Both types can have any even multiple of apertures 37, each pair of apertures separated from adjacent pairs of apertures by partitions 70, or, in the case of a pair of apertures at the end of the jumper, separated on one side from an adjacent pair by a partition 70, and bounded on the other side by a short side wall 71. In both types 80, 81, a latch 38 extends from first long side wall 72 between each pair of apertures 37, and rail members 301 project from second long side wall 73 adjacent short side walls 71 or partitions 70. Latches 38 and rail members 301 cooperate in the same manner as in the single jumper of FIGS. 1–6A to retain a terminal member associated with each pair of apertures within the jumper.

Multiple jumper 80 is essentially a plurality of the single jumpers shown in FIGS. 1–6A arranged with their short sides adjacent one another. One terminal member 10 is associated with each pair of apertures 37, and the separate terminal members are electrically isolated from one another.

Figure 9:
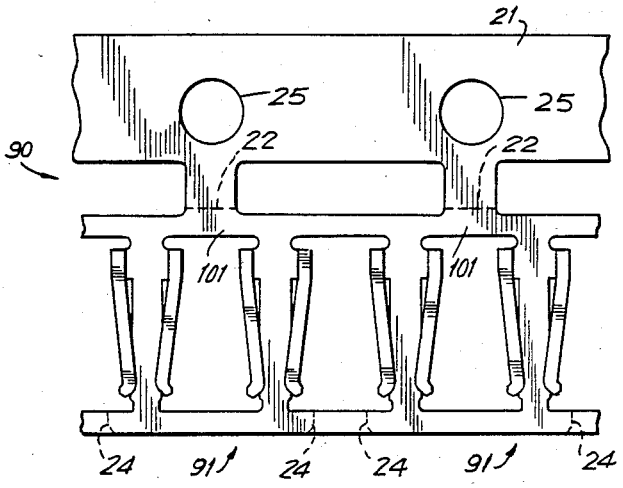
FIG. 9 is a plan view of a strip of terminal members for use with the housing of FIG. 8B.

Multiple jumper 81 is similar to jumper 80, but the partitions 70 do not extend all the way to the exit end of the jumper. The ends of partitions 70 in jumper 81 are spaced from the exit end by a distance equal to the width of exit end cross-piece 101 of terminal member 10. A strip 90 of the terminal members 91 used in jumper 81 is shown in FIG. 9. It is identical to strip 20 of terminal members 10, except that score lines 23 are missing. When terminal members 91 are separated from strip 90, exit end cross-pieces 101 form a continuous bar electrically interconnecting the terminal members 91. The continuous bar fits into the gaps between the ends of partitions 70 and the exit end of jumper 81. Jumper 81 is therefore a bus bar configuration, used to electrically interconnect many pins in one row.

Figure 10:
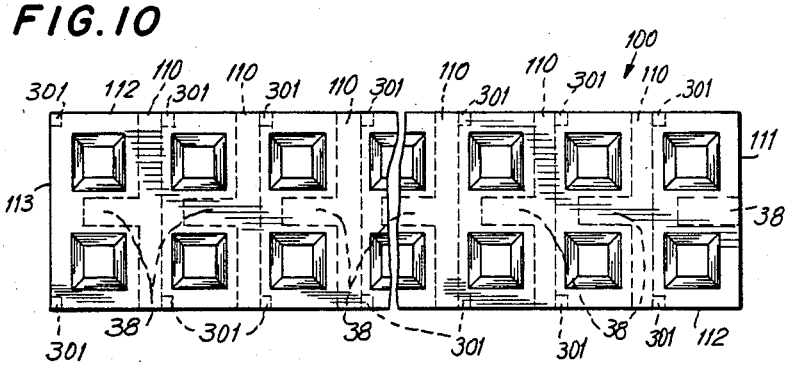
FIG. 10 is an entry end elevational view of a third preferred embodiment of the housing of this invention.

FIG. 10 shows the exterior of the entry end of another type of multiple jumper 100. Jumper 100 is essentially a plurality of the jumpers of FIGS. 1–6A with their long sides adjacent one another. Where the partitions 70 in jumpers 80, 81 replaced short side walls 33, 34, partitions 110 in jumper 100 replace long side walls 31, 32. Latches 38 extend from either first short side wall 111 or a partition 110 toward another partition 110 or second short side wall 113. Rails 301 extend from entry end to exit end along partitions 110 and second short side wall 113 where they meet long side walls 112. Each terminal member 10 of jumper 100 is electrically isolated from the other terminal members 10.

Thus, an electrical jumper has been described which can be easily assembled without the need to align terminal arms with slots in a housing, and whose terminal member is easily fabricated from a single piece of metal. Because no part of the terminal member is bent more than 90° during fabrication, there is no obstacle to using metal which has been plated before fabrication of the terminal because there is little danger that the base metal will break through the plating. One skilled on the art will recognize that the invention disclosed herein can be practiced by other than the embodiments described, which are presented for purposes of illustration and not of limitation, and the present invention is limited only by the claims which follow.

What is claimed is:

1. A jumper for electrically connecting terminal pins, said jumper comprising:

a housing of dielectric material, having:

a solid rectangular shape, an entry end having at least one pair of apertures for receiving said pins, an open exit end opposite said entry end, first and second long side walls parallel to each other and perpendicular to said entry and exit ends, first and second short side walls parallel to each other and perpendicular to said entry and exit ends and to said long side walls, a latch associated with each said pair of apertures comprising a ramp having a latch width and extending from said first long side wall toward said entry end and toward said second long side wall between the two apertures of said pair of apertures and further having a lip adjacent said entry end and said second long side wall, said lip having a lip height and being a first preselected distance from said second long side wall and a second preselected distance from said entry end, the sum of said lip height and said first preselected distance defining a third preselected distance, and a respective rail member extending along said second long side wall from said entry end to said exit end on either side of each said pair of apertures, each of said rail members projecting a fourth preselected distance from said second long side wall; and a terminal member associated with each said pair of apertures comprising a pair of twin-beam terminals of electrically conductive material for alignment with said apertures, each of said terminals having an entry end and an exit end, the entry and exit ends of each of said terminals connected to the entry and exit ends, respectively, of the other of said terminals by a respective electrically conductive cross-piece, the cross-piece which connects the entry ends of said terminals having a thickness greater than the difference between said first preselected distance and said fourth preselected distance, no greater than the difference between said third preselected distance and said fourth preselected distance, and no greater than said first preselected distance, and a width approximately equal to and no greater than said second preselected distance, said terminal member having a rectangular opening formed by said pair of terminals and said cross-pieces, said opening having a width no less than said latch width, said terminal member further having four tabs extending laterally outwardly from the corners thereof, said tabs being formed by extensions of said cross-pieces; wherein said terminal member is supported by said tabs on said rail members, spaced by said rail members from said second long side wall, and said lip of said latch engages that cross-piece of said terminal member which connects the entry ends of said terminals, said latch extending into said rectangular opening, thereby retaining said terminal member in said housing.

2. The jumper of claim 1 wherein the number of pairs of apertures is one, the number of said latches is one, the number of said terminal members is one, and the number of said rail members is two, each of said rail members extending along and inwardly of the intersection of said second long side wall and a respective one of said short side walls.

3. The jumper of claim 1 wherein the number of pairs of apertures is at least two, each said pair of apertures having an associated latch, an associated terminal member, and two associated rail members, said housing further comprising a respective partition for separating each said pair of apertures from the next adjacent pair of apertures, each said partition being parallel to and spaced from said short side walls, each of said rail members extending along and inwardly of the intersection of said second long side wall and a respective one of said partitions and short side walls.

4. The jumper of claim 3 wherein said partitions are coextensive with said short side walls, such that the terminal member associated with each said pair of apertures is electrically insulated from the terminal members associated with each other of said pairs of apertures.

5. The jumper of claim 3 wherein each said partition extends from said entry end of said housing to a point spaced from said exit end by a distance approximately equal to and no less than the width of the cross-piece which connects the exit ends of said terminals thereby defining an interconnecting gap in each said partition adjacent the exit end of said housing, said tabs at said exit end of said terminal member associated with each said pair of apertures being extended toward, and in electrical contact with, the tabs at the exit ends of the terminal members associated with each adjacent pair of apertures, said exit end tabs extending through said interconnecting gaps, whereby the terminal member associated with each said pair of apertures is in electrical contact with the terminal member associated with each other pair of apertures in said housing.

6. The jumper of claim 5 wherein all of said terminal members are formed from one piece of electrically conductive material, the exit end tab of each said terminal member being unitary with the exit end tab of the next adjacent terminal member.

7. The jumper of claim 6 wherein said electrically conductive material is hard phosphor bronze plated with nickel and overplated with gold.

8. The jumper of claim 1 wherein said dielectric material is a plastic.

9. The jumper of claim 8 wherein said plastic is a glass-filled polyester.

10. The jumper of claim 1 wherein said terminal member is formed from one piece of electrically conductive material.

11. The jumper of claim 10 wherein said electrically conductive material is hard phosphor bronze plated with nickel and overplated with gold.

12. A jumper for electrically connecting terminal pins, said jumper comprising:

a housing of dielectric material, having:

a solid rectangular shape, an entry end having at least two pairs of apertures for receiving said pins, an open exit end opposite said entry end, first and second long side walls parallel to each other and perpendicular to said entry and exit ends, first and second short side walls parallel to each other and perpendicular to said entry and exit ends and to said long side walls, a respective partition for separating each pair of apertures from the next adjacent pair of apertures, each said partition being parallel to and spaced from said short side walls, a latch associated with each said pair of apertures comprising a ramp having a latch width and extending from said first long side wall toward said entry end and toward said second long side wall between two apertures of said pair of apertures, and further having a lip adjacent said entry end and said second long side wall, said lip having a lip height and being a first preselected distance from said second long side wall and a second preselected distance from said entry end, the sum of said lip height and said first preselected distance defining a third preselected distance, and a respective rail member extending along said second long side wall from said entry end to said exit end on either side of each pair of apertures, each of said rail members projecting a fourth preselected distance from said second long side wall; and a terminal member associated with each said pair of apertures comprising a pair of twin-beam terminals for alignment with said apertures, each of said terminals having an entry end and an exit end, the entry and exit ends of each of said terminals connected to the entry and exit ends, respectively, of the other of said terminals by a respective electrically conductive cross-piece, the cross-piece which connects the entry ends of said terminals having a thickness greater than the difference between said first preselected distance and said fourth preselected distance, no greater than the difference between said third preselected distance and said fourth preselected distance, and no greater than said first preselected distance, and a width approximately equal to and no greater than said second preselected distance, said terminal member having a rectangular opening formed by said pair of terminals and said cross-pieces, said opening having a width no less than said latch width, said terminal member further having four tabs extending laterally outwardly from the corners thereof, said tabs being formed by extensions of said cross-pieces; wherein each of said terminal members is supported by said tabs on said rail members, spaced by said rail members from said second long side wall, and said lip of said latch engages that cross-piece of said terminal member which connects the entry ends of said terminals, said latch extending into said rectangular opening, thereby retaining said terminal member in said housing.

* * * * *